US006609542B2

(12) United States Patent
Anderson

(10) Patent No.: US 6,609,542 B2
(45) Date of Patent: Aug. 26, 2003

(54) TOTE BINS

(75) Inventor: Ian Anderson, Adelaide (AU)

(73) Assignee: Visy Films and Laminates Pty Limited (AU)

( * ) Notice: Subject to any disclaimer, the term of this patent is extended or adjusted under 35 U.S.C. 154(b) by 0 days.

(21) Appl. No.: 10/190,965

(22) Filed: Jul. 8, 2002

(65) Prior Publication Data

US 2002/0170922 A1 Nov. 21, 2002

Related U.S. Application Data

(62) Division of application No. 09/646,213, filed as application No. PCT/AU99/00178 on Mar. 18, 1999, now Pat. No. 6,427,872.

(30) Foreign Application Priority Data

Mar. 18, 1998 (AU) ..... PP2435

(51) Int. Cl.[7] ..... B65B 1/04
(52) U.S. Cl. ..... 141/21; 141/63; 141/85
(58) Field of Search ..... 141/4, 5, 18, 21, 141/63, 85; 222/83

(56) References Cited

U.S. PATENT DOCUMENTS

| | | | | |
|---|---|---|---|---|
| 4,173,858 A | * | 11/1979 | Cassia | 53/471 |
| 4,257,535 A | | 3/1981 | Mellett | |
| 4,493,438 A | | 1/1985 | Rutter | |
| 4,732,298 A | | 3/1988 | Dinslage | |
| 4,916,885 A | | 4/1990 | Loliger | |
| 5,099,895 A | | 3/1992 | Loeliger | |
| 5,373,872 A | * | 12/1994 | Mueller | 141/10 |
| 5,449,027 A | * | 9/1995 | Mueller | 141/10 |
| 6,193,108 B1 | | 2/2001 | Lepsius et al. | |

FOREIGN PATENT DOCUMENTS

| | | |
|---|---|---|
| DE | 3510859 | 10/1986 |
| EP | 072669 | 2/1983 |
| EP | 271242 | 6/1988 |
| WO | WO 98/41334 | 3/1997 |

* cited by examiner

*Primary Examiner*—Ehud Gartenberg
*Assistant Examiner*—Patrick Buechner
(74) *Attorney, Agent, or Firm*—Piper Rudnick LLP

(57) ABSTRACT

A cutter assembly for cutting a membrane which seals a transfer spigot on a container, the cutter assembly including a valve including a valve body adapted to engage the transfer spigot, the valve body, including a valve closure member, adapted to be moved between open and closed positions to open and close the valve, at least one elongate cutter which terminates in a cutting tip, the cutting tip being adapted to rupture or slit the membranes, actuation means for providing axial movement to the elongate cutter within the valve body, and the actuation means and/or the elongate cutter being adapted to move and cut a membrane independently of the operation of the valve closure member, and when the valve is in the open condition, the at least one elongate cutter can pass the valve closure member to engage the membrane to be cut.

8 Claims, 8 Drawing Sheets

TOTE BINS

This application is a divisional of application Ser. No. 09/646,213, filed Nov. 20, 2000, now U.S. Pat. No. 6,427, 872 which is a 371 of PCT/AU99/00178, filed Mar. 18, 1999, incorporated herein by reference.

FIELD OF THE INVENTION

The present invention relates to tote bins and more specifically to devices which enable polymeric liners to be inserted into tote bins and combination of valves and spigot systems for those.

BACKGROUND OF THE INVENTION

A tote bin is a bin or storage system which holds or carries bulk product. Tote bins are generally filled with a bulk product for the purposes of storing and transporting that bulk product to an end user.

Typically, such tote bins are lined with a plastic or polymer liner which holds the bulk product. The liner has an outlet tube or spigot hermetically sealed by a membrane. The outlet spigot allows for connection to a valve so as to fill or empty the product from the liner. The valve may or may not be attached during transport.

The products which are stored and carried in tote bins typically require sanitary or sterile conditions for the filling and emptying procedures. In the case of food product sterile conditions are generally required.

To achieve a required degree of sterility all surfaces which will contact the product need to be sterilised. Thus when filling or emptying the tote bin the valve is attached in a manner so that both the valve and the membrane can be sterilised together.

One of the disadvantages of prior art tote bins which have plastic liners is that the membrane which seals the outlet spigot is arranged on the outlet spigot in such a way that it is not readily sterilisable without a risk that the membrane or its seal to the spigot will be damaged by the fluid used for sterilisation.

A typical arrangement of a prior art outlet spigot and valve is illustrated in FIGS. 1 and 2. In FIGS. 1 and 2 the outlet spigot is generally indicated by the letter "A" and is illustrated as being attached to a liner indicated with the letter "L". The outlet spigot A has a membrane E hermetically sealed thereto.

A butterfly valve "B" is connected to the outlet spigot A as depicted in FIG. 2. The valve B includes a ring shaped cylindrical cutter C having a cut out segment. The cutter C is slidably located in the valve passage D, between a butterfly valve member G and the membrane E. The cutter C is a cylindrical ring with a cut out segment. When the valve B is closed the cutter C will not engage the membrane E until the valve is opened.

Once the valve B has been connected to the outlet A, and upon opening the butterfly valve member G, as illustrated in FIG. 2, the cutter C is moved to the left of the figure by an edge H of the valve member B. The edge H engages a bar J on the cutter C. The cutter C will then engage and cut the membrane E.

As the cutter C is a cylindrical ring with a cut out segment, it leaves a portion of the membrane uncut, thereby leaving a land which connects the cut portion of the membrane with the uncut. The land forms a hinge arrangement.

The arrangement illustrated in FIGS. 1 and 2 leads to several difficulties during sterilising procedures.

The first is that as soon as the valve B is opened, the membrane E is pierced by the cutter C. This means that for the arrangement of FIGS. 1 and 2 the valve components, seals and membrane cannot be sterilised through the valve.

To overcome this difficulty an additional inlet can be provided to allow the entry of a sterilising medium into the valve between the membrane E and the butterfly valve member G. In this case, prior to the opening of the butterfly valve member G, a sterilising medium is injected into the region between the butterfly valve member G and the membrane E to sterilise the membrane E, the internal portions of the outlet spigot A, the cutter C and some of the internal portions of the valve B. In this situation there will still remain the difficulty mentioned previously that the membrane or the seal between it and the outlet spigot will have the potential to be damaged.

The potential to be damaged dictates the maximum temperature and pressure at which sterilisation occurs. This in turn generally means a lower temperature and pressure sterilisation procedure will have to be used which in turn dictates that a long time will be used to achieve the necessary level of slerilisation.

One of the disadvantages of sterilising at a temperature and or pressure which is not as high as it should optionally be, is that it can take so long to complete the sterilisation process that downstream processes can be delayed.

It is an object of the present invention to provide a combination of a valve and spigot for attachment to a lined tote bin, and/or a method of sterilising and filling or emptying a lined tote bin and/or a cutter for a membrane which ameliorates, at least in part, at least one of the prior disadvantages of the prior art.

SUMMARY OF THE INVENTION

The present invention provides a tote bin liner having a liner wall to form a container, said liner wall including a transfer spigot which provides a passage from inside said liner to the outside thereof, said transfer spigot comprising:

- a tubular body which defines said passage, the tubular body having an opening on the distal end thereof;
- an annular surface located around the opening said annular surface providing a sealing surface adapted to engage a seal on a surface of a valve body when said valve body is assembled therewith;
- a rupturable membrane sealed to said annular surface by a continuous seal around said opening, said continuous seal being located on said annular surface.

The present invention further provides a tote bin liner having a liner wall to form a container, said liner wall including a transfer spigot which provides a passage from inside said liner to a tote bin outlet, said transfer spigot adapted to have a valve mounted thereto to provide a controlled outlet from the tote bin outlet, the transfer spigot comprising:

- a tubular body which defines said passage, the tubular body having an opening on the distal end therethrough;
- an annular surface located around the opening;
- a rupturable membrane sealed to said annular surface by a continuous seal around said opening, said continuous seal being located on said annular surface;
- the tubular body being shaped and configured such that when in use and said valve is mounted to the body, a seal on the valve will clamp the membrane against the annular surface.

Preferably said annular surface is generally perpendicular to the axis of the tubular body so that a seal on a valve clamped to the body will press the membrane against the sealing surface.

Preferably the annular surface has a radially inner portion and a radially outer portion and said continuous seal is located on said radially outer portion whilst the radially inner portion is adapted to have a seal of a valve which is an engagement with the tubular body seal therewith. Alternatively the continuous seal may be located on the radially inner portion and the radially outer portion is adapted to have the seal of a valve engage therewith.

Preferably said annular surface is included on a flange of said body.

The present invention also provides a cutter assembly to cut a membrane which seals a transfer spigot on a container, said cutter assembly having:

a valve including a valve body adapted to engage with said spigot, the valve body including a valve closure member, adapted to be moved between open and closed position to open and close the valve;

at least one elongate cutter which terminates in a cutting tip, said cutting tip being adapted to rupture or slit said membrane;

actuation means for providing axial movement to said cutter within said valve body; and said actuation means and/or said elongate cutter body being adapted to move said cutter body to cut a membrane independently of the operation of the valve closure member.

Preferably said actuation means is adapted to rotate said cutter about an axis to define an arcuate cutting action.

Preferably said cutting tip is any one of the following: a pointed spike; a blade; a crescent shaped knife; a C-shaped knife; a D-shaped cutter having an open segment.

Preferably said actuation means is adapted to move said cutter to a side of said valve closure member remote from the spigot.

Preferably said cutter is formed in at least two elongate sections, each terminating in a cutting tip, or alternatively the cutter bifurcates into two arms, each arm terminating in a cutting tip.

The cutter and actuation means may be housed in a tubular housing which is adapted to be coaxially mounted to the valve body, the actuation means in use being adapted to move the cutter through the valve body, past valve closure member when the valve closure member is open, into engagement with the membrane in cut said membrane.

The invention extends to an assembly comprising a tubular housing, cutter and actuation means for a cutter assembly according to the invention.

The invention also provides a sterilising, cutting and transfer tube wherein the tube has a cutting assembly as described in any of the paragraphs above.

The present invention provides a method of sterilising an impervious rupturable membrane attached to a tote bin spigot on a liner and subsequently filling or emptying said liner, said impervious rupturable membrane closing a passage which connects the exterior of said liner to the interior of said liner; said method comprising the steps of:

1 attaching a valve having a flow passage therethrough and a valve closure member mounted within the passage moveable between open and closed positions, the valve closure member being spaced away from the membrane;

2 passing a sterilising medium into at least the space between said membrane and the valve closure member to sterilise the outside surface of said membrane and that part of the internal flow passage within said valve between said membrane and the valve closure member;

3 piercing said membrane with a cutter which passes along the flow passage past the valve closure member when the valve closure member is in the open position.

Preferably said valve closure member is in an open position at the start of and for the duration of step 2.

Preferably said sterilising medium sterilises the whole of the internal flow passage within said valve.

Preferably said valve is of the butterfly type.

Preferably said cutter is linked to a rotatory actuator to rotate said cutters.

Preferably the cutter is one of the types described in preceding paragraphs.

BRIEF DESCRIPTION OF THE DRAWINGS

An embodiment of the present invention will now be described, by way of example only, with reference to the accompanying drawings in which.

DETAILED DESCRIPTION OF THE EMBODIMENTS

Figure 1:
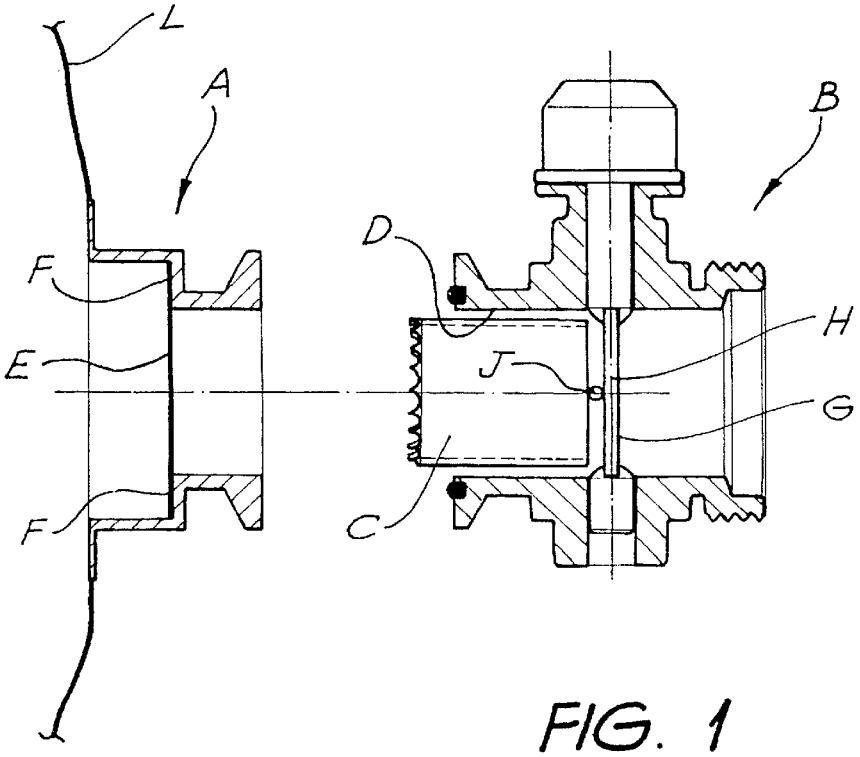
FIG. 1 PRIOR ART
FIG. 1 illustrates a spigot a valve of the prior art.
Figure 3:
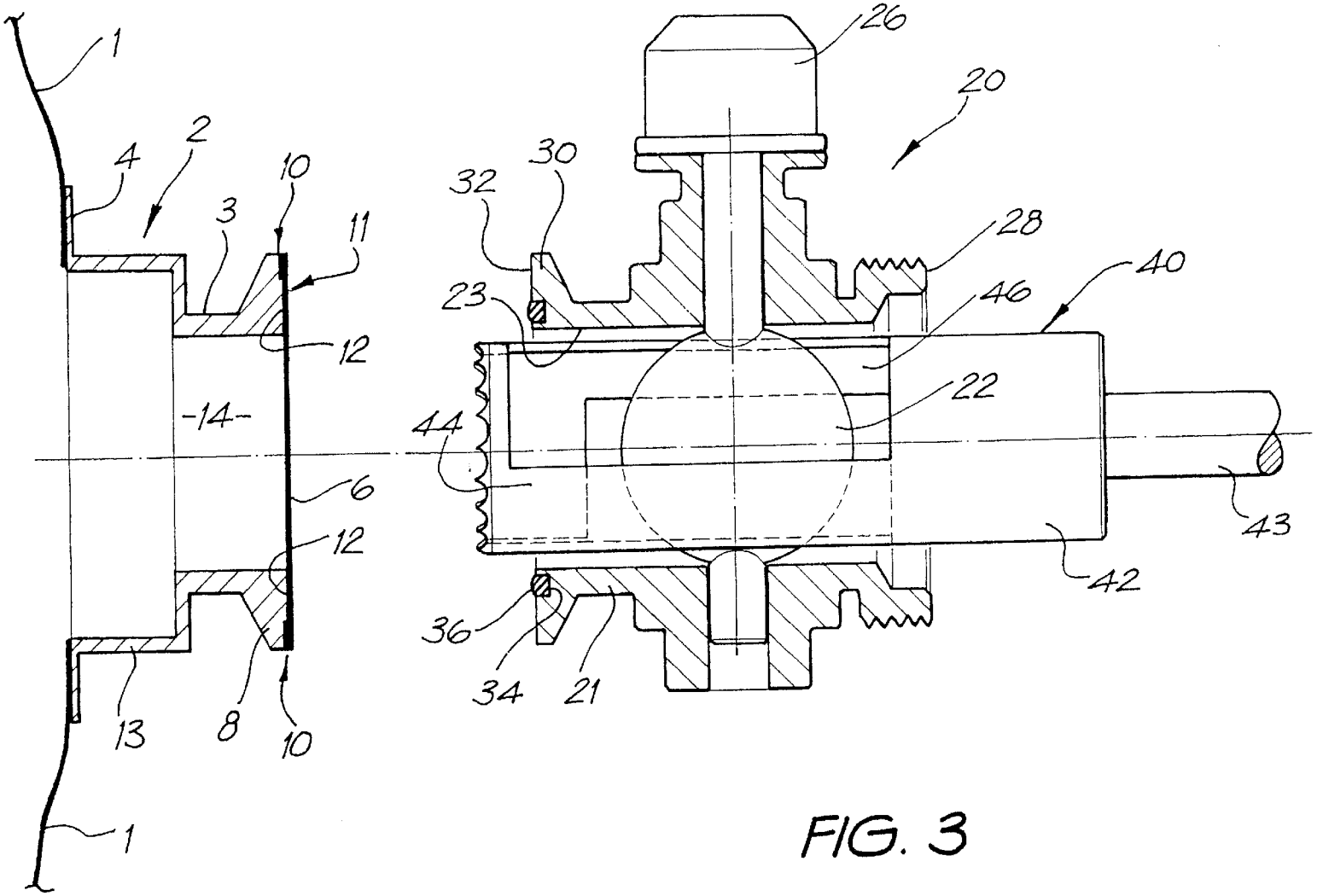
FIG. 3 illustrates a cross section through an embodiment of the present invention with the valve separated from the spigot.
Figure 3A:
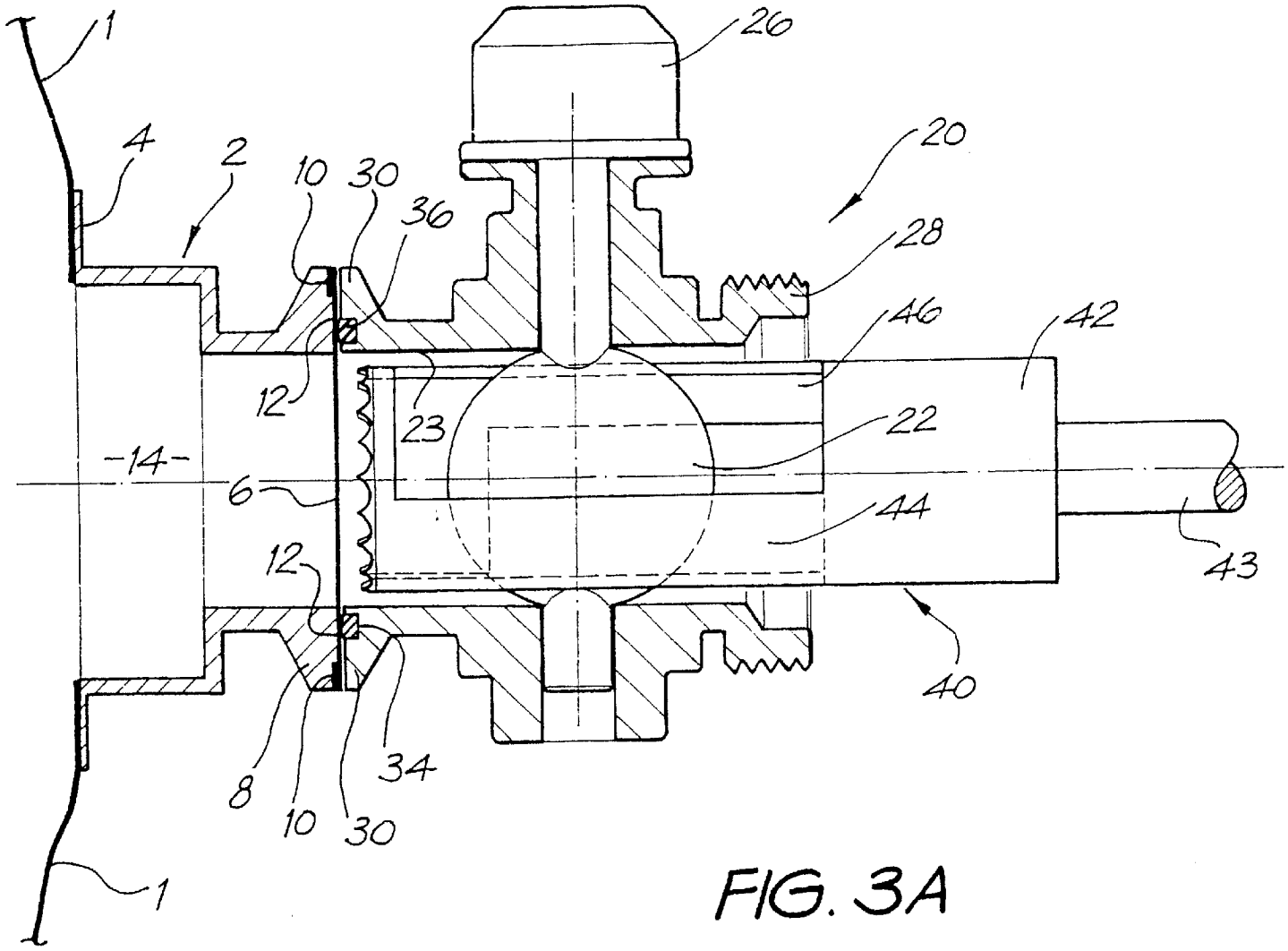
FIG. 3A illustrates a similar view to that of FIG. 3 but with the valve and spigot connected.

Illustrated in FIGS. 3 and 3A is an annular transfer spigot 2 which is connectable or formed with a liner 1 such as the liner "L" of FIG. 1 for insertion into a tote bin (not illustrated). Preferably the spigot 2 is made from polyethylene, but other materials could be used, providing they do not lose their structural integrity during or after the sterilisation process which will be described below. The liner is preferably manufactured from polyethylene or may be made from a barrier material such as metallised polyester, or foil depending upon the type of product to be contained by the liner. The spigot 2 includes a tubular body 13 having an axial internal passage 14 therethrough to allow flow communication between the interior and exterior of the liner.

The body 13 is formed with one end having a flange 4 for attachment to the liner. The outer portion of body 13 reduces in diameter to form a neck 3 and then expands to provide an outer flange 8 at the distal end thereof.

The flange 8 has a generally flat annular surface 11 thereon which surrounds the passage 14 through the body. A disc shaped membrane 6 is heat sealed to the annular surface 11. The heat seal 10 is continuous around the annular surface 11. The heat seal 10 is preferably formed in the radially outer peripheral section of the annular surface 11. Preferably the membrane 6 is manufactured from a polyester laminated LPDE material, but other cuttable or rupturable materials such as are known in the art may be used.

The annular surface 11 also includes an annular shaped inner section 12 between the heat seal 10 and internal passage 14. The flange 8 is preferably not joined or otherwise connected to membrane 6, in this inner annular section 12. (Alternatively the membrane can be heat sealed across the full width of the surface 11, and this possibility is discussed below).

For typical tote bin applications the internal passage 14 is preferably approximately 50 mm in diameter.

Figure 6:
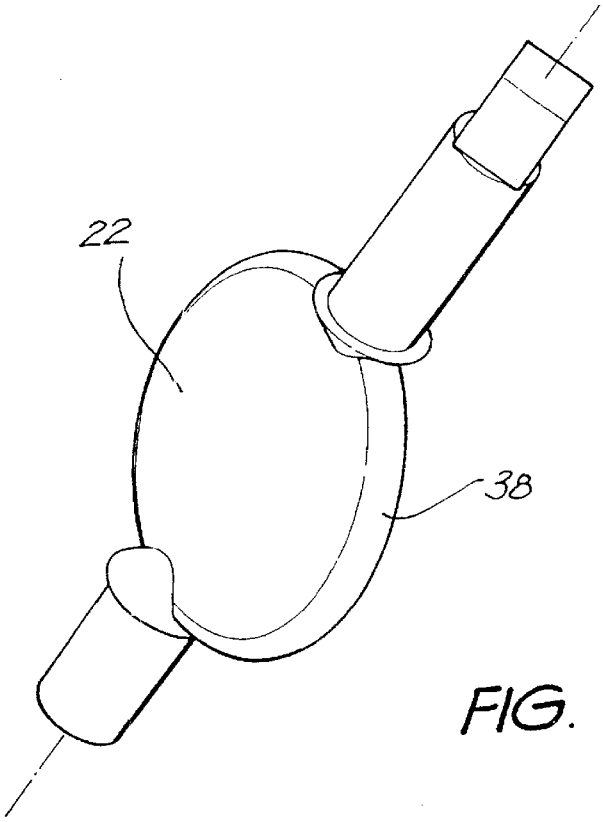
FIG. 6 illustrates a view of the butterfly shaped valve closure member for the valve depicted in FIG. 3.

Also illustrated in FIG. 3 is a valve 20 which is of the butterfly type. The valve 20 includes a valve body 21 having a flow passage 23 therethrough and a disc shaped butterfly valve member 22 located in the flow passage 23 (illustrated in more detail in FIG. 6) which is rotatable so as to close or open the passage 23 by means of a handle 26.

On the end of the valve 20 remote from the spigot 2 is a tapered seat union 28 which is of threaded formation to allow for the connection of the valve to one or more of the following: fill station, sterilisation unit, emptying station, a membrane cutter or other device.

The other end of the passage 23 terminates with a flange 30 which has a tapered construction when viewed in cross section. The taper on the flange 30 is similar to the taper on the flange 8 also illustrated in FIG. 3 to allow a clamping ring (not shown) to surround and clamp together the flanges 30 and 8. The flange 30 has a generally planar sealing face 32 of similar dimensions and diameter to the annular surface 11 which is provided with a sealing groove 34 which receives an annular seal 36. The seal 36 illustrated has a rectilinear side which locates in the groove 34 and an arcuate front side which protrudes from the face 32. This arrangement of seal is able to maintain its structural characteristics during sterilisation procedures. If desired the groove 34 could be shaped to receive a standard O-ring. The seal 36 may be made of a material such as food grade seal material.

When connected the heat seal 10 surrounds and is spaced radially outwardly from the location of contact (being in the area 12) of the seal 36 against the membrane 6. In use, during sterilisation procedures, this arrangement allows the contact and pressure of seal 36 compressing membrane 6 to flange 8 in the area 12 to isolate the heat seal 10 from the elevated pressure and temperature which the outer face of the membrane is subjected to.

Figure 4:
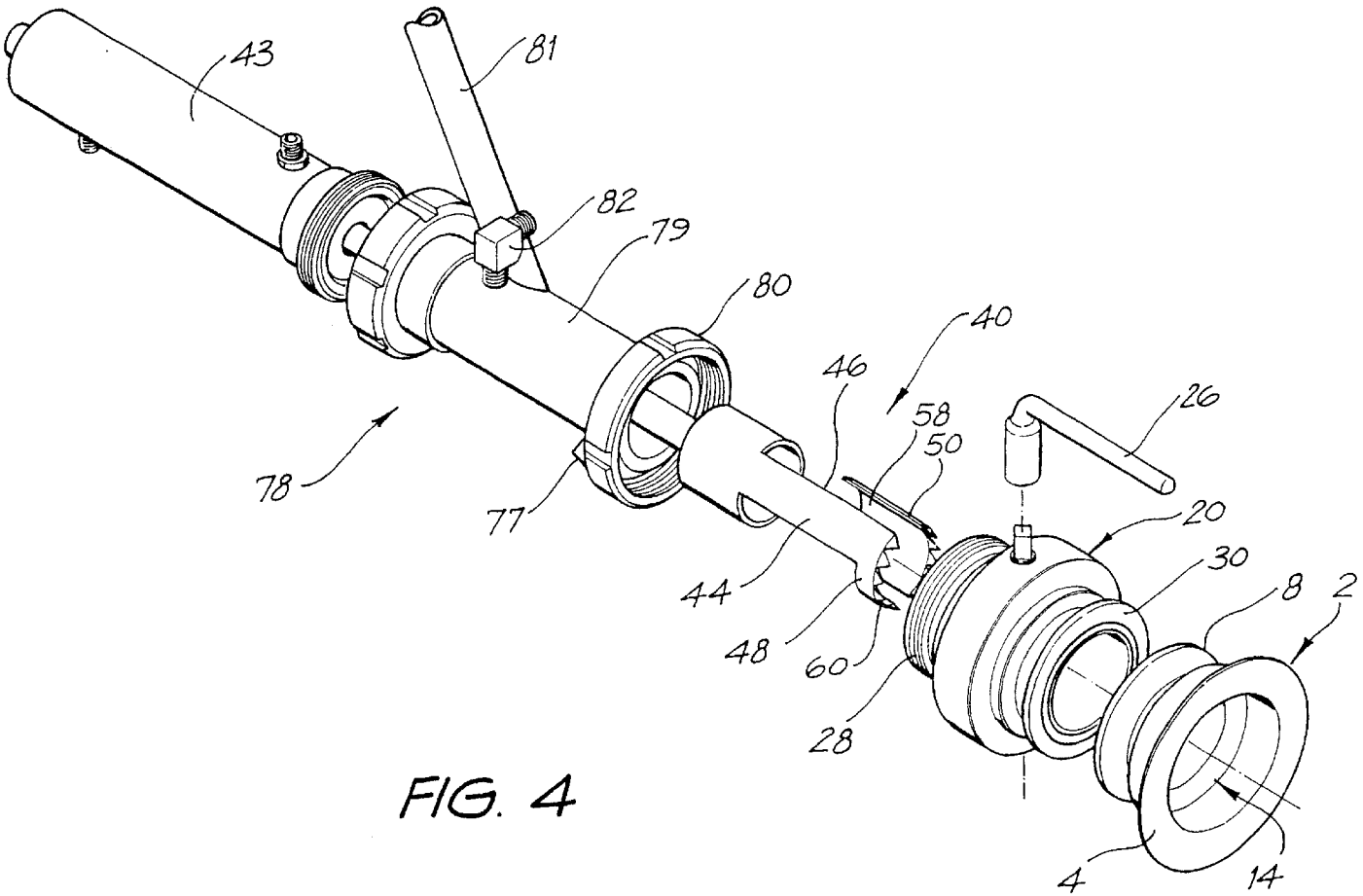
FIG. 4 illustrates the sterilising and entry mechanism and cutting mechanism for use with the spigot and valve of FIG. 3, with the spigot illustrated without an attached membrane.

Once the valve 20 and spigot 2 are connected together, a sterilising/cutting/filling assembly 78 (as illustrated in FIG. 4) is attached to the valve 20 via nut 80 to the union 28.

The assembly 78 comprises a tubular housing 79 which contains an axially movable cutter 40 for cutting the membrane 6, an actuator for moving the cutter, and means for sterilising the interior of the valve body, and the outer face of the membrane 6. These components are described in more detail below.

Once the assembly 78 is connected to the valve 20 the butterfly valve member 22 is opened and sterilising medium is caused to enter the tubular housing 79 via an inlet connection 82. The preferred sterilising medium is steam at 148° C. and approximately 3.8 bar of steam pressure. The steam passes through the housing 79, and into the internal passage 23 in the valve 20. The steam will act on the outside surface of the membrane and the internal surfaces of the valve 20 which are exposed to the steam.

Figure 2:
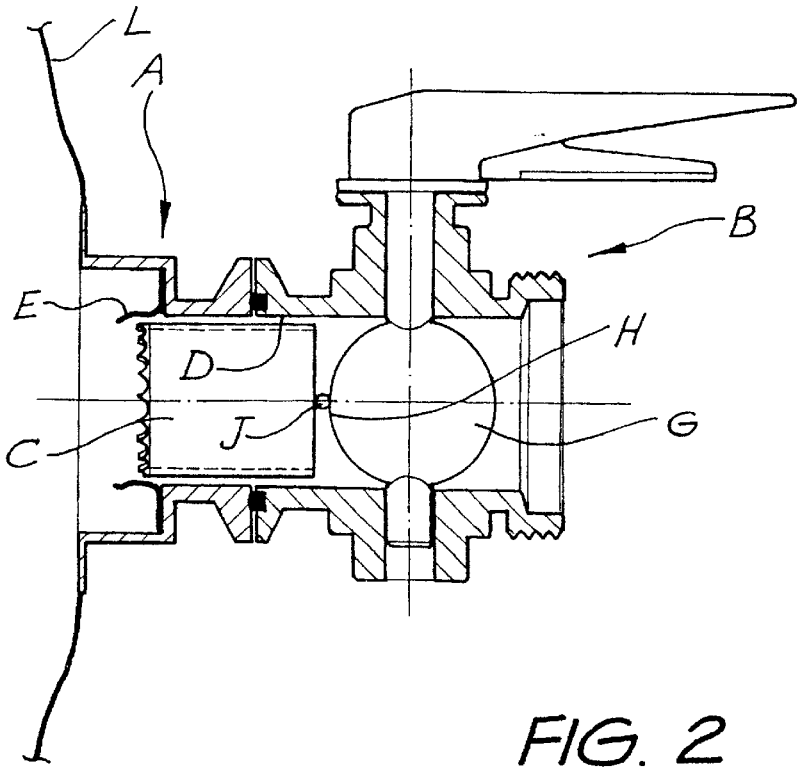
FIG. 2 PRIOR ART
FIG. 2 illustrates the assembled spigot and valve of FIG. 1.

This high temperature and pressure would ordinarily, in the case of the prior art, cause damage to the heat seal holding the membrane to the spigot (as illustrated in FIGS. 1 and 2) due to the elevated pressure and the temperature acting on it. However, as mentioned above, the seal 36 provides a protective barrier for the heat seal 10, thereby allowing relatively high pressure and temperature conditions to be used for sterilisation.

After the sterilisation process has been conducted for approximately 10 seconds (with the steam at the specified temperature and pressure) the supply of sterilising medium is withdrawn via a steam outlet fitting 77 (which is only partly visible in FIGS. 4 and 4A) and the cutter 40 will operate. The purpose of the cutter is to rupture the membrane 6, thereby allowing fluid to pass from, or into, the liner, depending on the application.

FIGS. 3 and 3A illustrate the cutter 40 which is slidable in an axial direction within the valve 20. The cutter 40 is illustrated in perspective view in FIG. 4 and in more detail in FIG. 5.

The cutter 40 is of a tubular construction and includes a cylindrical base 42 which can be connected either directly or indirectly to an actuator 43 mounted on or within the housing 79. The actuator 43 may comprise a pneumatic or hydraulic piston and cylinder assembly, a rotary actuator or other motor driven device and, optionally, a hand operated rotation device.

Figure 5:
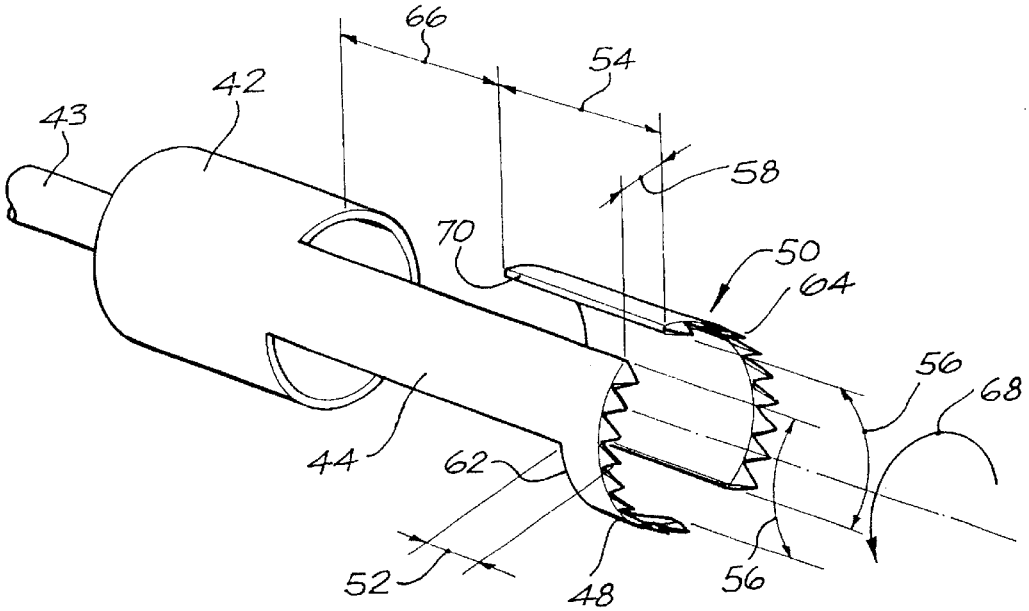
FIG. 5 is a detailed perspective view of the cutter for the apparatus depicted in FIG. 4.

Extending away from the base 42 are two support arms 44 and 46, (the latter of which is better illustrated in FIGS. 3 and 3A as the support arm 46 cannot be seen in FIG. 4 or 5). The support arms 44 and 46 each have an arcuate shape in cross section which helps to give rigidity and strength thereto.

Arcuate cutting blades 48 and 50 are attached to the distal ends of the support arms 44 and 46. The cutting blade 48 has a length 52 while the cutting blade 50 has a length 54 which is approximately 2 to 3 times longer than the length 52. Both cutting blades 48 and 50 have approximately the same circumferential dimensions.

The adjacent side edges of the blades 48 and 50 are separated from each other by a gap 58 at both the top and bottom thereof. The gap 58 extends from the side edges of the blades 48 and 50 back through to the base 42. The gap 58 is sized to receive the butterfly valve member 22 when the valve member is open, so that the blades 48 and 50 can pass along the internal passage 23 in the valve 20. The cutter 40 is housed within the tubular housing 79.

After the interior of the valve 20 has been sterilised the cutter will be moved axially from the housing, past the open valve member 22, to cut the membrane 6. The cutter is moved by means of the actuator 43, also housed within the housing 79. Preferably the actuator 43 will comprise a hydraulic or pneumatic piston and cylinder assembly. As the blades 48 and 50 engage the membrane 6, cutting tips 60 on the leading ends of the blades 48 and 50 cut the membrane in two C shaped cuts, depicted in FIG. 9.

The cutter 40 may then be pushed further into the spigot 2 until the rear end 62 of blade 48 moves past the membrane 6. It will be noted that, due to part circular shape of the blades 48 and 50, two diametrically opposite lands 91 and 92 of membrane material retain the central region of the membrane to the outer peripheral region thereof.

Once the end 62 of blade 48 is clear of the membrane 6, the butterfly valve member 22 will be located in the gap 66 between the rear end of blade 50 and the base 42 of the cutter 40. The length of the gap 66, is greater than the diameter of the butterfly valve 22 so that the butterfly valve member 22 is at that stage located in a relatively wide recess, rearward of both blades 48 and 50.

Once the butterfly valve member 22 is located in the gap 66, the cutter 40 is rotated by the actuator 43 (see FIG. 4) which will rotate the blades 48 and 50 in direction 68 through an angular displacement of some 10° to 30° so that the top edge 70 of cutter 50, will rotate and cut the closest land to it, so as to sever that land. Once this land is cut, the other land is allowed to remain intact so that the severed central portion of the membrane 6 remains attached to the radially outer portion of the membrane 6 by means of that intact land.

The width of the remaining land is selected dependent upon the friction which will be applied to that land by the product moving into and or out through the spigot 2. For many applications a width of 10 mm is sufficient when the membrane is made of laminated polyethylene and polyester, (or a lamination of polyethylene, aluminium foil and nylon or other commonly used laminations which allow the heat sealing of a polyethylene layer to the spigot 2), to prevent the movable membrane portion shearing off at the remaining land. If a product used with the spigot 2 will produce a friction of greater magnitude than designed for the width of land may need to be increased.

Figure 4A:
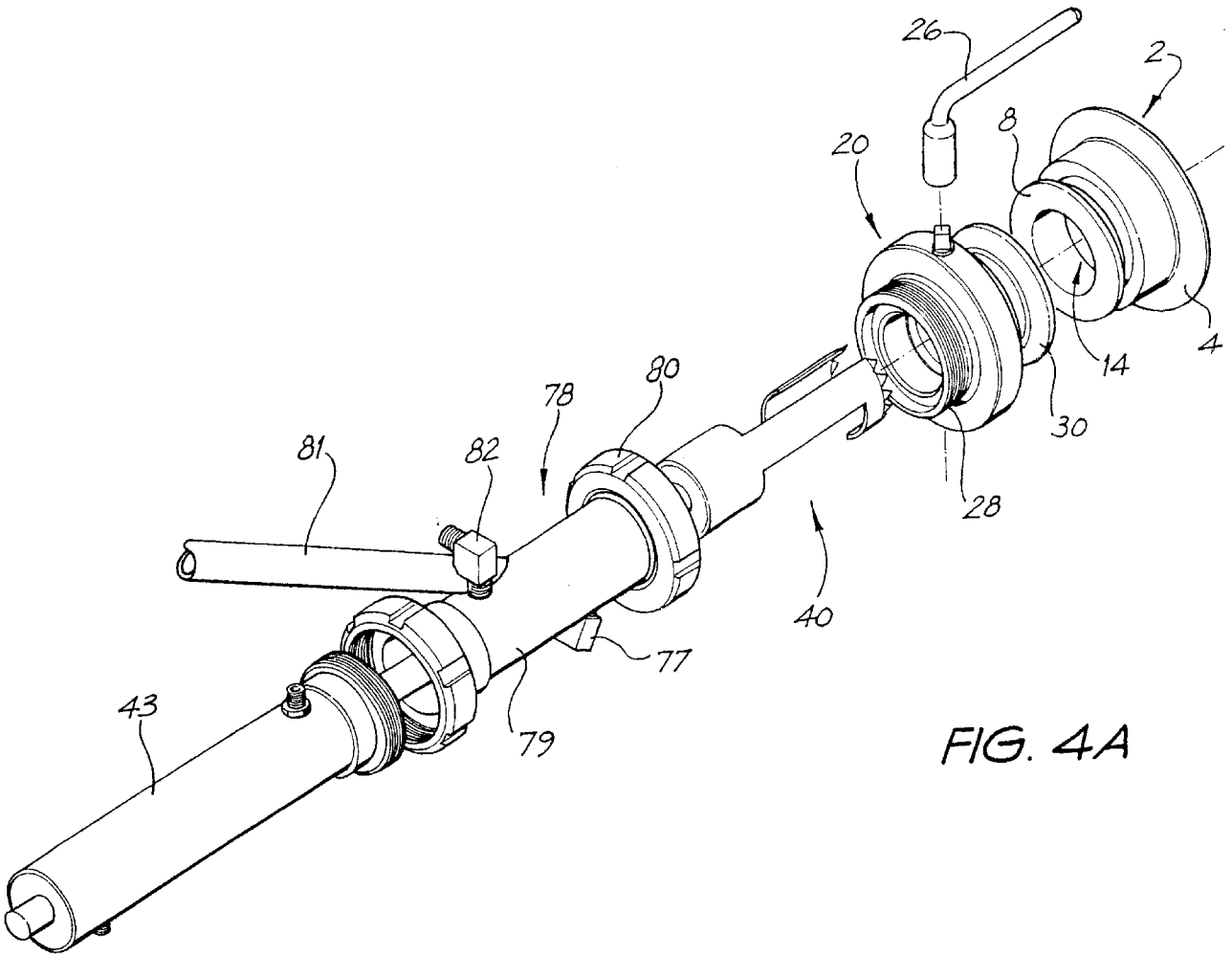
FIG. 4A illustrates the apparatus depicted in FIG. 4 from a rear view.
Figure 4B:
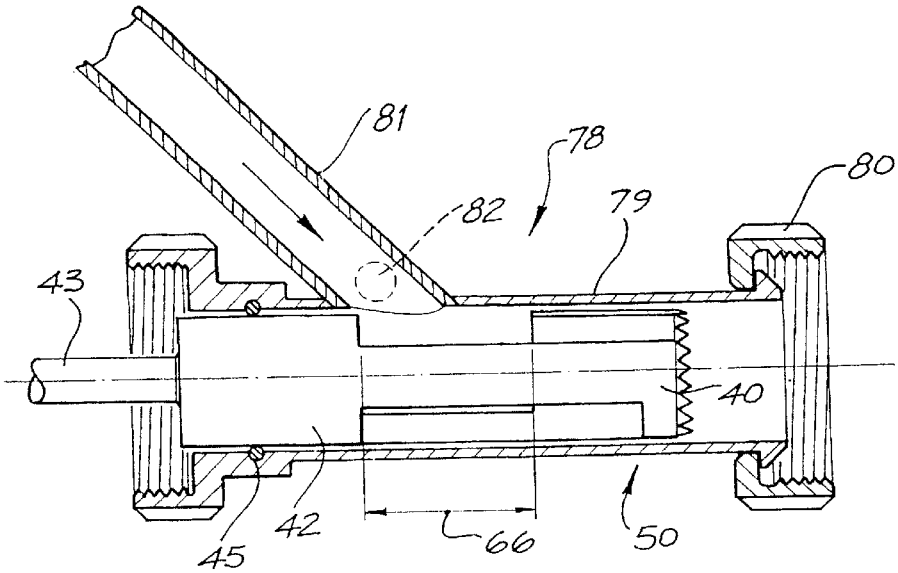
FIG. 4B illustrates a schematic cross section through a part of the apparatus depicted in FIGS. 4 and 4A.

After the cutter 40 has completed its cutting of the membrane, the liner can be filled with or emptied of product. This is done by the transfer tube 81 which is illustrated in FIGS. 4 and 4A and in cross section in FIG. 4B. In FIG. 4B it can be seen that the transfer tube 81 connects to and opens into the tubular housing 79 in the region of the gap 66 between the blade 50 and the base 42.

Filling of the liner is carried out as follows, The base 42 of the cutter 40 moves back into the tubular housing 79 and is sealed with respect thereto by a sliding seal 45, so as to prevent steam and product from passing the seal 45 towards the actuator 43. Once the cutter 40 and its base 42 have been retracted to the position indicated in FIG. 4B, a valve (not illustrated), mounted as close as practicable to the junction of the housing 79 and transfer tube 81, is opened thus allowing food or other product to pass through the junction and through the gaps in the cutter 40 so as to flow through to the valve and into the liner via the spigot 2.

Once transfer of product has taken place the nut 80 is disconnected from the union 28 and the operator will allow some steam or sterilising fluid to enter the housing 79 via the inlet 82 so that the steam or sterilising fluid will flush away any product which may remain inside the housing 79.

If desired the support arm 44 and blade 48 could be dispensed with and the blade 50 alone utilised. However, if the blade 48 is not present, the blade 50 will need to be rotated through a much larger arc to provide a maximum possible cut. In this arrangement it is envisaged that a cut of approximately 270° can be created by the blade 50 alone.

In some situations and locations a tote bin is filled at a site and is supplied to a customer without a valve being attached. In these cases there is a second spigot on the liner to allow the liner to be filled, but not emptied. In this situation a spigot 2 is used as an outlet only, and will be provided with a hermetically sealed membrane 6. The spigot 2 may be covered by a cap or other protective covering.

Once at the end users site, the user attaches a valve 20 (or if a valve is already attached but the spigot 2 has not had its hermetic seal broken), the operator connects a sterilising/cutting/emptying assembly (similar or the same as sterilising/cutting/filling assembly 78 except that transfer tube 81 is used to draw the product away). In this way the exposed valve internals and the membrane can be sterilised first, then the cutter passed through the membrane to allow product to flow from the liner through the valve 20. Once this is done the food or other product in the tote bin can be emptied therefrom.

Otherwise if the membrane is cut at the filling location, once the liner is filled, the butterfly valve is closed and in the region adjacent the union 28, a wad may be located which will include a germicide, so as to keep sterile any product which may leak through the valve or may be caught on the wrong side of the butterfly valve member 22. Once a wad is in position, an end cap is placed on the union 28. When a tote bin prepared in this way arrives at the end user's site, the end user will remove the end cap and wad (if it is present) and then will connect a sterilising/cutting/emptying assembly (similar to assembly 78) to sterilise, cut the membrane and empty the tote bin.

Figure 9:
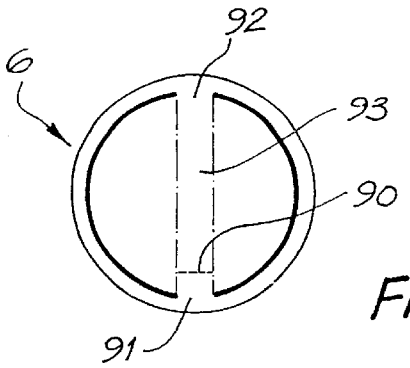
FIG. 9 illustrates diagrammatically the D shaped flaps formed in a membrane by axial movement of C-shaped cutters.

If desired instead of rotating the blades 48 and 50 to cut the membrane 6, the cutter 40 can simply be pushed through the membrane to form two C-shaped cuts as illustrated in FIG. 9. These will be hinged to the main body of the membrane through a land which is connected at one location on the held membrane and at another diametrically opposite location.

The two C-shaped cuts will form two D-shaped flaps (see FIG. 9). These D-shaped flaps will not provide as big an opening as a single land (approximately some 33% in a 50 mm diameter spigot 2) and under normal circumstances this reduction would be a restriction in the flow path. To remove the restriction, a larger spigot 2 and larger inlet end to valve 20 could be provided to compensate for the reduction in the size of the opening. Such a valve 20 with a larger inlet end may terminate in a union 28 which is the standard 50 mm DIN union, or it may be a larger union if desired.

If desired, the blades 48 and 50 could be replaced by a single blade mounted on a rotatable arm which is attached to a rotation device so as to rotate the arm and the cutters. Such a single cutter can be in the form of a blade (see item (5) in FIG. 8) or a pointed spike (see item (4) in FIG. 8) for insertion into the membrane and rotated through an arc within the confines of the opening provided by one half of the butterfly valve. Once the cut or slit is scribed, formed, sheared or made into the membrane 6, the single cutter is retracted then inserted into the membrane 6, through the other opening on the other side of the butterfly valve member 22. The single blade is then rotated in an arc and withdrawn. Two C-shaped cuts providing D-shaped flaps will result, such as that illustrated in FIG. 9.

Figure 8:
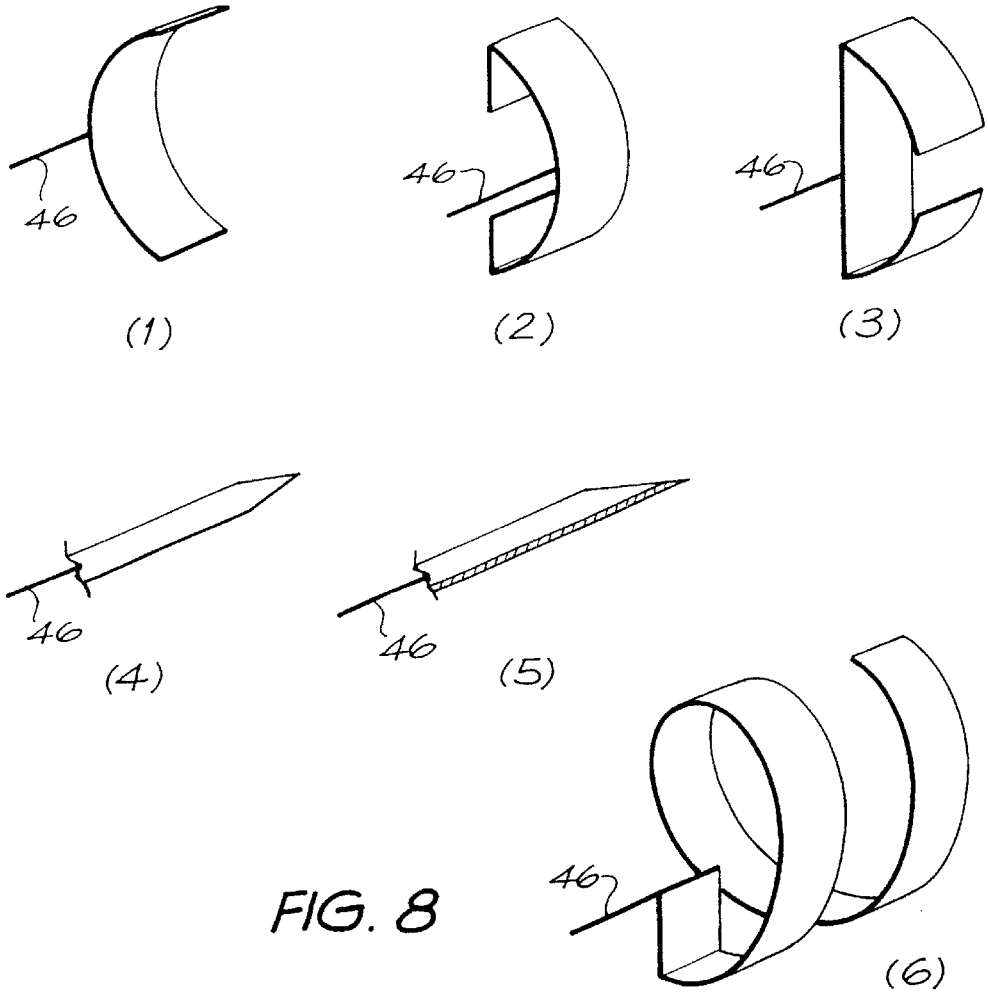
FIG. 8 illustrates schematically the shapes of cutting members adapted for use with axial and rotation movement of the actuator.

In another variation, the single blade 50 (see item (1) in FIG. 8) can be provided onto a base 42. The blade 50 can be inserted into the membrane 6 and then rotated part of the way then retracted and inserted into the other side of the opening provided by the butterfly valve member 22. The blade 50 can then be rotated the rest of the way to produce a flap connected to a membrane connected to the rest of the membrane by means of a single land.

In the embodiments described above which produce two D-shaped flaps, the D-shaped flaps as illustrated in FIG. 9 are hinged to a rectangular section 93 of membrane material. The rectangular section 93 connects to the radially outer part of the membrane 6 via two lands 91 and 92 located at either end of the rectangular section 93.

If desired, the membrane 6 can be provided with a line of weakness 90 (as illustrated in FIG. 9) adjacent or at the land 91. The D-shaped flaps hinge to the rectangular section 93 of membrane material between the lands 91 and 92. In use the line of weakness 90 will break once the product begins to flow out of or into the liner. This will remove the restriction which would be otherwise present. By breaking at a line of weakness 90, it ensures that the rectangular section 93 will not break simultaneously at two locations. Such simultaneous breakage risks the complete separation of the cut portion of the membrane 6, with the risk that complete separation will mean that the cut portion of the membrane will be inadvertently included in a manufacturer's final product.

In the preferred embodiment there is only one spigot 2 in the liner, and through which the tote bin is filled and emptied. However, in some arrangements, the valve 20 and spigot 2 are used only as an emptying port, near to the lowest point of the tote bin. In these arrangements the liner may have a filling point at another location, which may or may not be formed with a spigot 22, and then sealed after filling.

Figure 7:
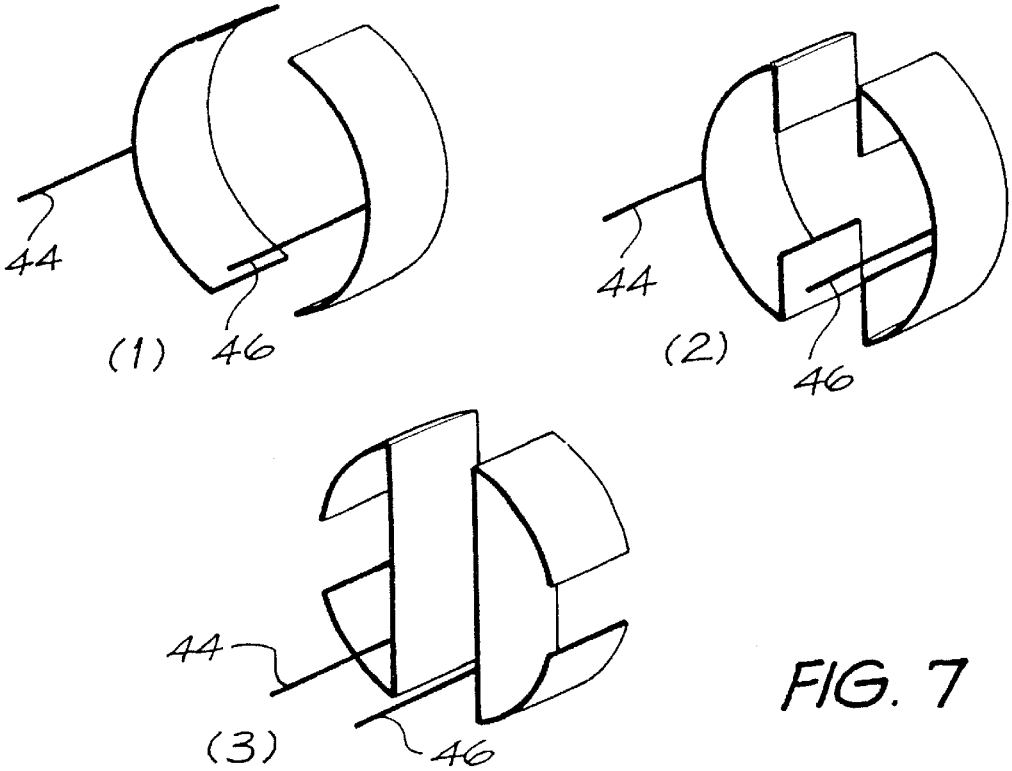
FIG. 7 illustrates schematically the shapes of different cutting members adapted for use with axial movement of the actuator;.

The cutter shapes illustrated in FIG. 7 are those that can form two slits simultaneously with axial movement only. Other cutters are indicated in FIG. 8.

All the cutters illustrated in FIG. 8 are designed to cut one section of membrane at a time, through the openings provided by the butterfly valve member. They will require retraction from the membrane portion first cut and then rotational movement to move to the other opening provided by the butterfly valve member 22. Once adjacent the other opening, the respective cutters are moved axially to reengage the membrane 6 and then rotated yet again, to complete the slit.

The cutters of items (2) and (3) of FIGS. 7 and 8, produce a D-shaped flap that connects to the rectangular section 93 of FIG. 9 by a much smaller hinge than that provided by the cutters of item 1 of FIG. 7 or 8. The helical cutter of item (6) of FIG. 8 works by both a rotation and axial movement.

In the above preferred and illustrated embodiment, the membrane 6 is heat sealed to the flange 8 by means of an annular band 10 of heat seal. While in the preferred embodiment this heat seal 10 is approximately 3 mm wide, such a heat seal 10 will be more than adequate if placed outside of or under the seal 36 on the valve 20, when the valve and the spigot 2 are connected.

If desired, the whole of the area 12 can also be heat sealed, with the seal 36 bearing against the membrane. That is all of the outwardly facing surface area of the flange 8, being that area which will engage the flange 30 of the valve 20, can be heat sealed to the membrane 6.

Further, providing sufficient width of heat seal 10 is provided, the heat seal 10 could be located on the flange 8 within the area bounded by the seal 36. Even though heat and pressure may influence the heat seal 10 of the membrane 6 to the flange 8, if sufficient surface area is provided then the softening that may occur will not be acting long enough to damage the connection between the membrane 6 and the flange 8. The exact width of the heat seal 10 will, it is envisaged, be greater than 3 mm. It is expected that a heat seal 10 having a width of some 8 to 10 mm may be sufficient.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

What is claimed is:

1. A method of sterilising an impervious rupturable membrane attached to a tote bin spigot on a liner and subsequently filling or emptying said liner, said impervious rupturable membrane closing a passage which connects the exterior of said liner to the interior of said liner, said method comprising the steps of:

attaching a valve having a flow passage therethrough and a valve closure member mounted within the passage moveable between open and closed positions, the valve closure member being spaced away from the membrane;

passing a sterilising medium into at least the space between said membrane and the valve closure member to sterilise the outside surface of said membrane and that part of the internal flow passage within said valve between said membrane and the valve closure member;

piercing said membrane with a cutter which passes along the flow passage past the valve closure member when the valve closure member is in the open position.

2. A method according to claim 1 wherein the valve closure member is in an open position at the start of and for the duration of the sterilisation step.

3. A method according to claim 2 wherein said sterilising medium sterilises the whole of the internal flow passage within said valve.

4. A method according to any one of claims 1 to 3 wherein the valve is a butterfly type valve.

5. A method according to claim 1 wherein the cutter is rotated either during or after the piercing of the membrane takes place.

6. A method according to claim 2 wherein the cutter is rotated either during or after the piercing of the membrane takes place.

7. A method according to claim 3 wherein the cutter is rotated either during or after the piercing of the membrane takes place.

8. A method according to claim 4 wherein the cutter is rotated either during or after the piercing of the membrane takes place.

* * * * *